US006259047B1

(12) United States Patent
Kimata et al.

(10) Patent No.: US 6,259,047 B1
(45) Date of Patent: Jul. 10, 2001

(54) POWER TOOLS WITH IMPROVED SWITCH DEVICES

(75) Inventors: Hirokazu Kimata; Shin Sugiura, both of Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/455,465

(22) Filed: Dec. 6, 1999

(30) Foreign Application Priority Data

Dec. 4, 1998 (JP) ..... 10-345794

(51) Int. Cl.[7] ..... H01H 9/28
(52) U.S. Cl. ..... 200/43.17; 200/321; 200/332.2
(58) Field of Search ..... 200/43.01, 43.11, 200/43.16, 43.17, 43.19, 43.22, 50.12, 61.85, 318, 321, 322, 329, 330, 332.2, 333, 339, 522

(56) References Cited

U.S. PATENT DOCUMENTS 4,002,874 * 1/1977 Brown ..... 200/321
4,598,182 * 7/1986 Breslin ..... 200/43.11
4,910,365 * 3/1990 Kuo ..... 200/43.16
5,045,648 * 9/1991 Fogleman, Sr. ..... 200/43.16
5,047,598 * 9/1991 Osika et al. ..... 200/43.16
5,723,833 * 3/1998 Thrasher ..... 200/50.12

FOREIGN PATENT DOCUMENTS

2315841-B2 * 10/1974 (DE) ..... H01H/3/20
8514075-U1 * 6/1985 (DE) ..... H04Q/9/00
4443797-A1 * 6/1996 (DE) .

OTHER PUBLICATIONS

Catalog page—1988 Ackermann+Schmitt "Elektrowerkzeuge".

* cited by examiner

*Primary Examiner*—Michael Friedhofer
(74) *Attorney, Agent, or Firm*—Dennison, Scheiner, Schultz & Wakeman

(57) ABSTRACT

A power tool includes a motor and a switch device for starting and stopping the motor. The switch device includes an operation member and an on-operation prevention device. The operation member can pivot about a pivotal axis between an on position and an off position and has an on-operation arm and an off-operation arm on either side of the pivotal axis for operation by an operator. The on-operation prevention device serves to prevent the operation member from moving from the off position to the on position and to permit the operation member to move from the off position to the on position.

25 Claims, 8 Drawing Sheets

POWER TOOLS WITH IMPROVED SWITCH DEVICES

BACKGROUND OF THE INVENTION

1. Field of the Invention

The present invention relates to power tools, such as power grinders for polishing, abrading or cutting workpieces, having improved switch devices for starting and stopping the power tool motors.

2. Description of the Related Art

A known power grinder is shown in FIG. 10 and is generally indicated by reference numeral 41. The grinder 41 comprises a substantially cylindrical housing 42 and a handle 43 connected to the rear end of the housing 42. A motor 49 is disposed centrally within the housing 42 and serves to drive a spindle 44 that downwardly extends from the front end of the housing 42. A grinding disk 45 is mounted on the spindle 44.

A grip portion 46 and a switch device 47 are mounted on the handle 43. The switch device 47 includes a switch circuit that is connected between the motor 49 and a power supply cable 48. The power supply cable 48 extends outward from the rear end of the handle 43 for connection with a power source. The handle 43 has a joint portion 43*a* that is joined to the housing 42 and that has a substantially cylindrical configuration corresponding to the configuration of the housing 42. The grip portion 46 is adapted be grasped with one hand of an operator, and therefore, the grip portion 46 has a configuration suitable for hand-held operation. More specifically, the grip portion 46 has a substantially cylindrical configuration that has a diameter smaller than the housing 42. The switch device 47 has an operation member 47*a* that can pivot about a pivotal axis 47*b* like a seesaw so as to open and close the switch circuit. In addition, the position of the switch device 47 is determined such that the operator can press either side of the operation member 47*a* with respect to the pivotal axis 47*b* so as to turn on and off the switch circuit while he grasps the grip portion 46.

However, with the known power grinder 41, the switch device 47 may be accidentally turned on an off, because the operation member 47*a* can be freely accessed.

SUMMARY OF THE INVENTION

It is, accordingly, one object of the present invention to teach power tools having improved switch devices, in which accidental switching operations can be reliably prevented.

According to the present invention, a power tool is taught that includes a motor and a switch device for starting and stopping the motor. The switch device preferably includes an operation member and an on-operation prevention device. The operation member can pivot about a pivotal axis from an on position to an off position and has an on-operation arm and an off-operation arm on either side of the pivotal axis for operation by an operator. The on-operation prevention device preferably serves to prevent the operation member from moving from the off position to the on position.

Therefore, the operator cannot turn on the switch device unless the on-operation prevention device has been moved to a position that permits the operation member to move from the off position to the on position. As a result, switch device can be reliably prevented from accidentally or unintentionally being turned on.

In one representative embodiment, the on-operation prevention device includes an on-operation prevention member that can move between an on-operation prevention position and a releasing position. The on-operation prevention member substantially covers the on-operation arm of the operation member when the on-operation prevention member is in the prevention position and substantially uncovers the on-operation arm when the on-operation prevention member is in the releasing position. Therefore, the on-operation arm can be reliably prevented from being accessed by the operator when the on-operation arm is in the on-operation prevention position.

Preferably, the on-operation prevention member can move from the on-operation prevention position to an on-operation position via the releasing position so as to move the operation member from the off position to the on position by means of the on-operation arm. Therefore, the on-operation prevention member can be operated to release its on-operation prevention function and then to turn on the switch device. As a result, the switch device can still be conveniently operated, despite the incorporation of the on-operation prevention device.

In addition, preferably, the power tool further includes a biasing member for applying a first biasing force to move the on-operation prevention member from the on-operation position to the releasing position and for applying a second biasing force to move the on-operation prevention member from the releasing position to the on-operation prevention position. Therefore, when the operator releases the on-operation prevention member after turning on the switch device, the on-operation prevention member can automatically return to on-operation prevention position. As a result, the operability can be improved.

Other objects, features and advantages of the present invention will be readily understood after reading the following detailed description together with the accompanying drawings and the claims.

BRIEF DESCRIPTION OF THE DRAWINGS

FIG. 3 is a sectional view of the switch device in which an operation member is prevented from being moved and thereby prevents a switch circuit from being turned on;

FIG. 6 is a sectional view similar to FIG. 3 in which the on-operation prevention member has returned to the original position after the switch device has been turned on;

DETAILED DESCRIPTION OF THE INVENTION

Figure 1:
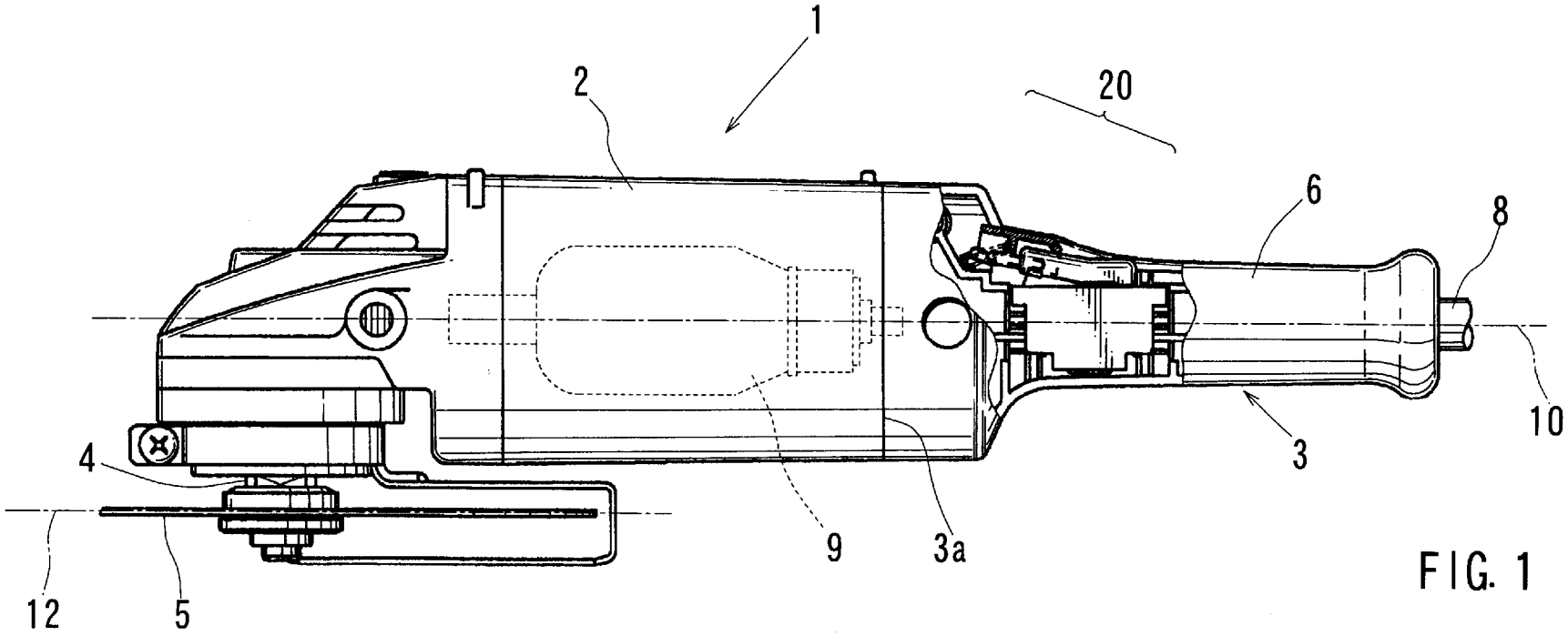
FIG. 1 is a side view of a representative power grinder having an improved switch device.

Power tools are taught having a motor and a switch device for starting and stopping the motor. The switch device preferably may include an operation member and an on-operation prevention device. Preferably, the operation member can pivot about a pivotal axis between an "on" position and an "off" position and having an on-operation arm and an off-operation arm on either side of the pivotal axis for operation by an operator. The on-operation prevention member may be operated to prevent and permit the operation member from moving from the off position to the on position.

In a representative embodiment, the on-operation prevention device serves to prevent the on-operation arm from being accessed by an operator.

The on-operation prevention device may include an on-operation prevention member that can move between an on-operation prevention position for preventing the on-operation arm from being operated by the operator and a releasing position for permitting the on-operation arm to be operated by the operator.

The power tool may further include a biasing member, such as a spring, for normally biasing the on-operation prevention member in a direction toward the on-operation prevention position.

Preferably, the on-operation prevention member substantially covers and substantially uncovers the on-operation arm of the operation member when the on-operation prevention member is in the prevention position and the releasing position, respectively.

In a representative embodiment, the on-operation prevention member can move from the on-operation prevention position to an on-operation position via the releasing position so as to move the operation member from the off position to the on position by means of the on-operation arm.

Preferably, the on-operation prevention member can move from the on-operation prevention position to the releasing position in a first direction and can move from the releasing position to the on-operation position in a second direction.

In a representative embodiment, the first direction is a substantially radial direction about the pivotal axis of the operation member, and the second direction is substantially perpendicular to the first direction.

Preferably, the power tool further includes a guide device for permitting combined movement of the on-operation prevention member in the first and second directions.

The biasing member may therefore apply a first biasing force in the first direction to move the on-operation prevention member from the on-operation position to the releasing position and may apply a second biasing force in the second direction to move the on-operation prevention member from the releasing position to the prevention position.

In one representative embodiment, the biasing member is a single spring interposed between a part of a tool body and the on-operation prevention member, and the spring serves to apply both the first and second biasing forces.

In one representative embodiment, the guide device includes an engaging portion and a guide recess. The engaging portion may be formed on the on-operation prevention member, and the guide recess may be formed in a part of a tool body for engaging the engaging portion.

The guide recess may include a first guide recess and a second guide recess. The first guide recess may extend in the first direction, and the second guide recess may extend substantially perpendicular to and intersect with the first guide recess. The first guide recess may have a first recess end on the side opposite to the operation member and a second recess end on the side of the operation member. The engaging portion may have a first engaging end on the side opposite to the operation member and a second engaging end on the side of the operation member. The second guide recess intersects the first guide recess at an intersecting end that may have a first corner edge on the side opposite to the operation member and a second corner edge on the side of the operation member. Preferably, the relationship among length L1 of the engaging portion between the first engaging end and the second engaging end, length L2 of the first guide recess between the first recess end and the second recess end, length L3 between the second recess end and the first corner edge, and between the first recess end and the second corner edge is chosen to be L2>L4>L1>L3. Therefore, when the first end of the engaging portion is substantially positioned at the first recess end of the first guide recess, the second engaging end of the engaging portion can move into the second guide recess, so that the on-operation prevention member can pivot in the second direction.

Each of the additional features and method steps disclosed above and below may be utilized separately or in conjunction with other features and method steps to provide improved power tools and methods for designing and using such power tools. A representative example of the present invention, which example utilizes many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe a representative example of the invention.

A representative embodiment of a power tool will now be described with reference to FIGS. 1 to 7. FIG. 1 illustrates a side view of a representative embodiment of a power grinder 1 incorporating a switch device 20.

As shown in FIG. 1, the grinder 1 may have a substantially cylindrical housing 2 and a handle 3 connected to the rear end of the housing 2. A spindle 4 may downwardly extend from the front end of the housing 2 and may be rotatably driven by a motor 9 that is centrally disposed within the housing 2. A disk 5 may be attached to the spindle 4.

A grip portion 6 and a switch device 20 may be mounted on the handle 3. The switch device 20 may be electrically connected between the motor 9 and a cable 8 that extends outward from the rear end of the handle 3 for connecting to a power source (not shown). The handle 3 also may include a joint portion 3*a* for connecting to the rear end of the housing 2. Preferably, the joint portion 3*a* has a cylindrical configuration corresponding to the configuration of the housing 2. The grip portion 6 is adapted to be grasped with one hand of an operator. The grip portion 6 may have a cylindrical configuration and may have a central axis 10 that extends from the central axis of the housing 2. Preferably, the grip portion 6 has a diameter smaller than the diameter of the housing 2, so that the operator can easily grasp the grip portion 6.

The disk 5 may be mounted on the spindle 4, so that it extends at a right angle with respect to the spindle 4. The disk 5 may be selected from a variety of grinding disks, such as a polishing disk, an abrading disk or a diamond cutting disk, according to the machining operation to be performed.

Figure 2:
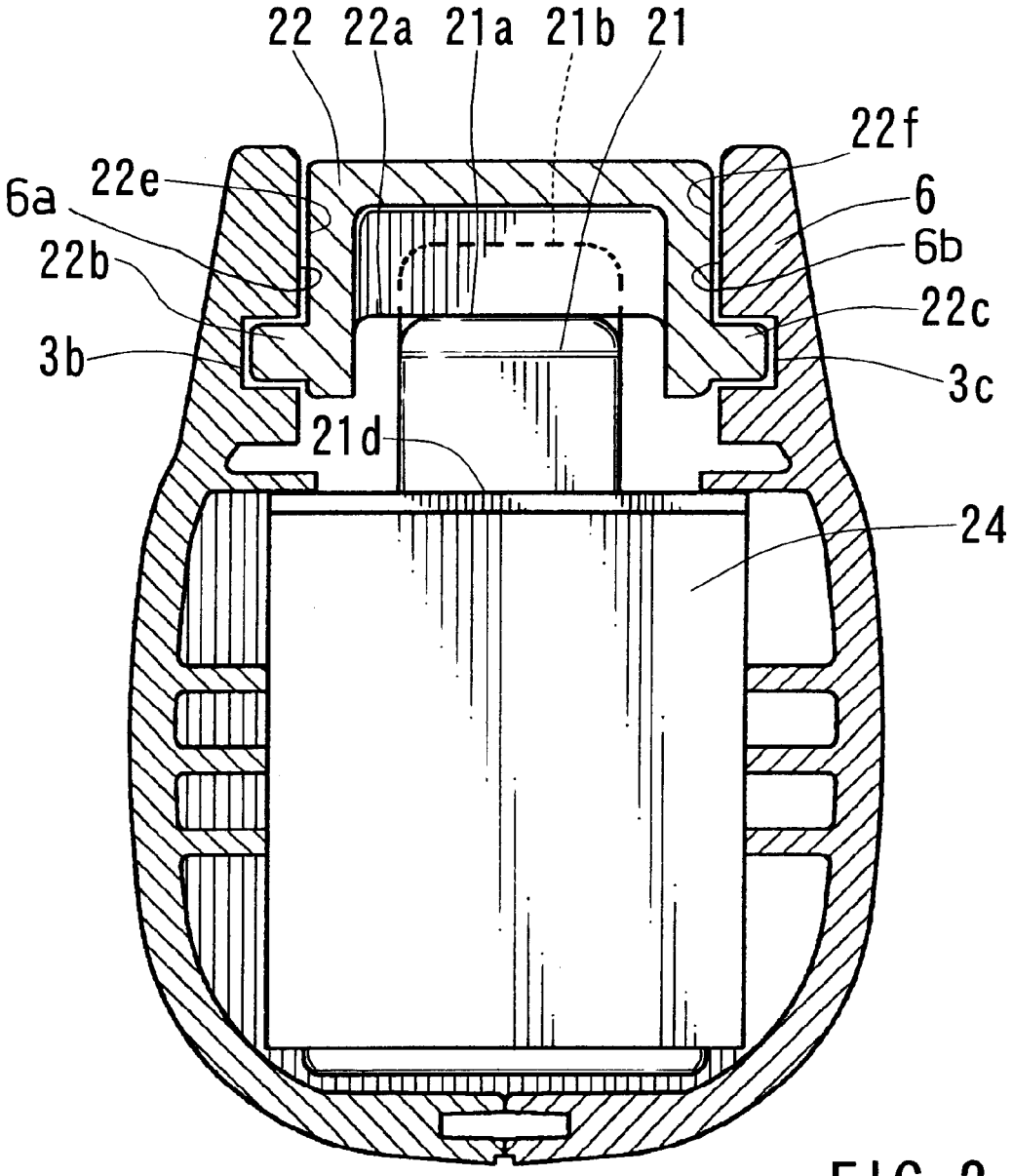
FIG. 2 is a vertical sectional view of the power grinder taken along line II—II in FIG. 5(A)
Figure 3:
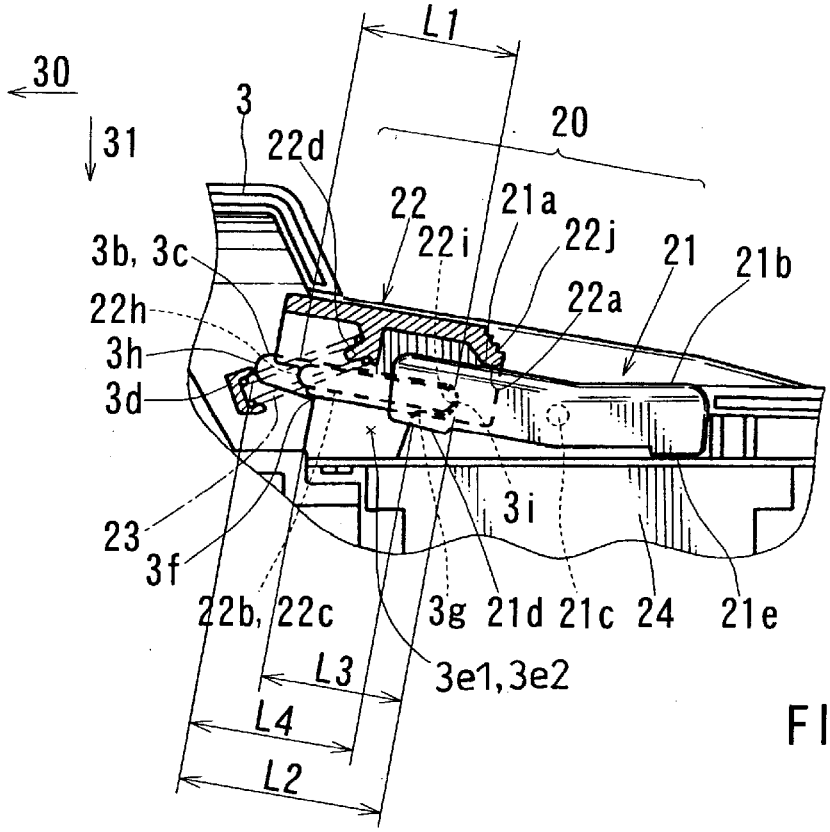
Figure 4:
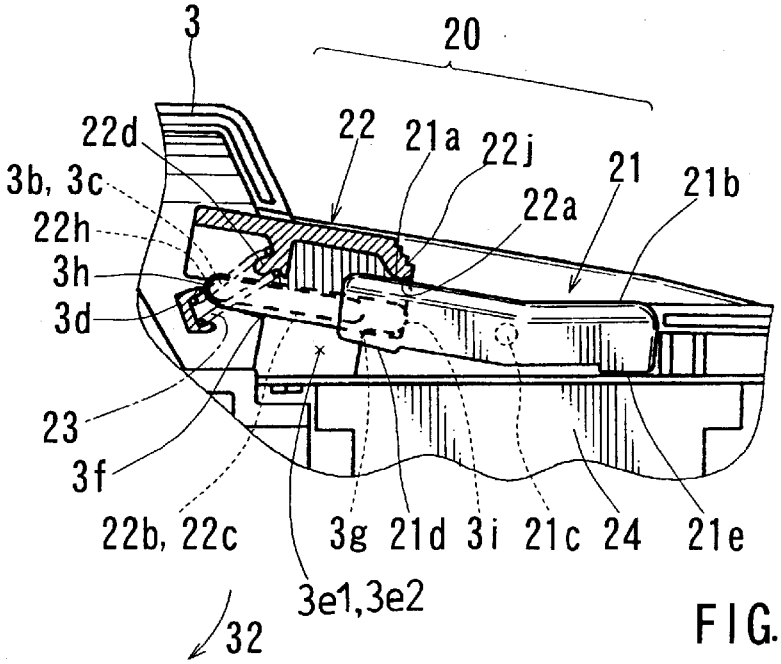
FIG. 4(A) is a sectional view similar to FIG. 3 in which the operation member is permitted to move to turn on the switch device.
FIG. 4(B) is a sectional view showing one of engaging portions of an on-operation prevention member and a corresponding guide recess of a handle in the state of FIG. 4(A)
Figure 4:
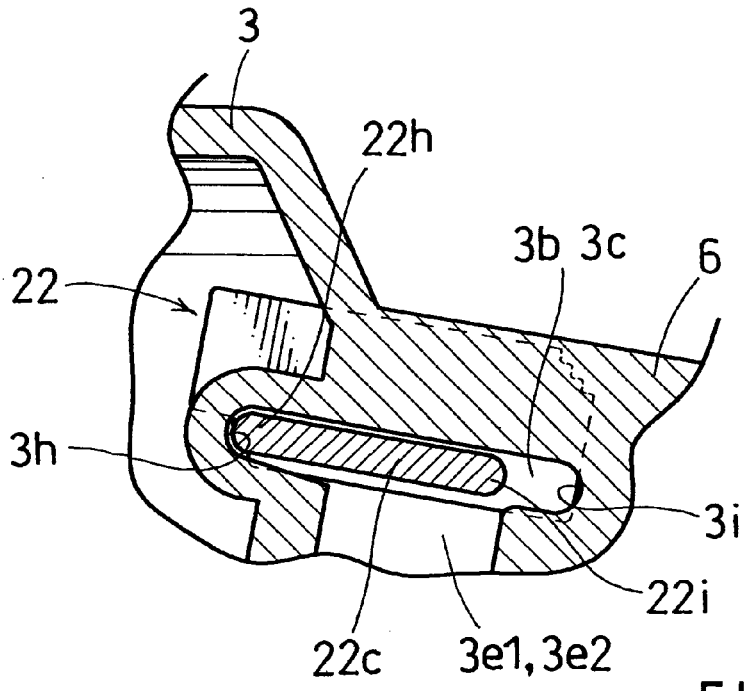

As shown in FIGS. 2 to 4, the switch device 20 may be disposed within the grip portion 6 and may include an operation member 21, an on-operation prevention member 22, a biasing member 23 and a switch body 24.

Preferably, the operation member 21 can pivot in a seesaw-like manner relative to the grip portion 6 about a pivotal axis 21*c* that extends between the two opposite walls 6*a* and 6*b* of the grip portion 6. The opposite walls 6*a* and 6*b* may define an opening formed in the grip portion 6, through which the operation member 21 and the on-operation prevention member 22 are exposed to the outside surface of the grip portion 6. The operation member 21 may have an on-operation arm 21*a* and an off-operation arm 21*b* on the opposite sides with respect to the pivotal axis 21*c*.

In a state shown in FIG. 3, a clearance exists between the free end of the on-operation arm 21*a* and an upper surface of the switch body 24 in a direction opposite to arrow 31, while the lower side 21*e* of the free end of the off-operation arm 21*b* contacts the upper surface of the switch body 24. In this state, an electrical switch circuit (not shown) that may be disposed within the switch body 24 is in the open or "off" state, so that power is not supplied to the motor 9. As a result, the disk 5 does not rotate.

Figure 5:
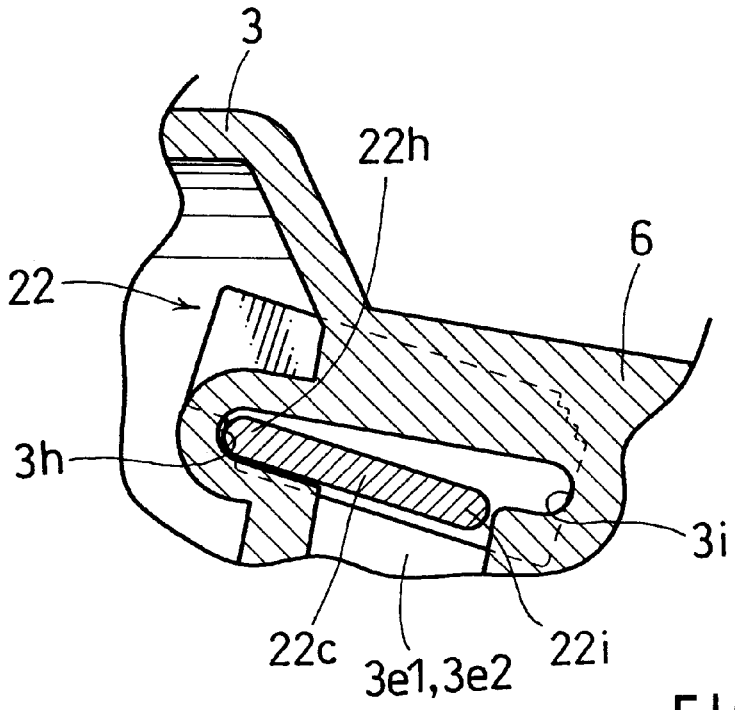
FIG. 5(A) is a sectional view similar to FIG. 3 in which the operation member has been moved to turn on the switch device.
FIG. 5(B) is a sectional view showing one of the engaging portions and the corresponding guide recess in the state of FIG. 5(A)
Figure 5:
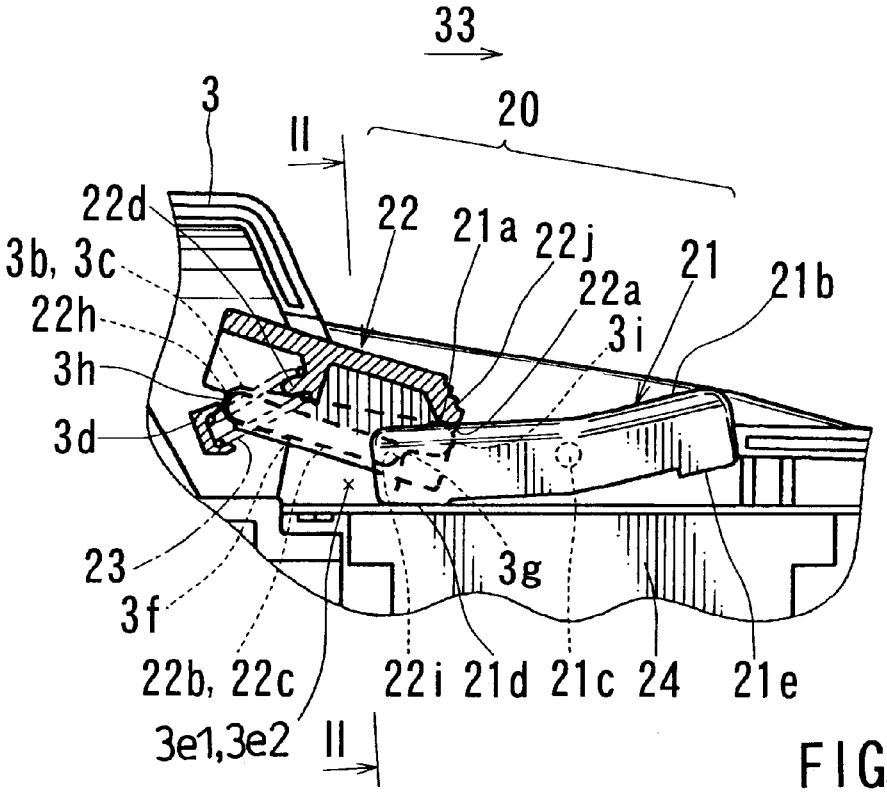

On the other hand, in a state shown in FIGS. 5(A) and 5(B), the lower side 21*d* of the free end of the on-operation arm 21*a* contacts the upper surface of the switch body 24, while a clearance exists between the free end of the off-operation arm 21*b* and the upper surface of the switch body 24. In this state, the electrical switching circuit is in the closed or "on" state, so that power may be supplied to the motor 9 to rotate the disk 5. Thus, the switching circuit is turned on and off when the operator presses the on-operation arm 21*a* and the off-operation arm 21*b* in the direction of arrow 31, respectively. A retainer spring (not shown) may be incorporated to maintain the operation member 21 in either of the positions shown in FIGS. 3 and 5. Therefore, the state of FIG. 3 will hereinafter be referred to as the "off-holding position" and the state of FIGS. 5(A) and 5(B) will be hereinafter referred to as the "on-holding position", respectively.

The on-operation prevention member 22 may have a substantially inverted U-shaped cross section, as shown in FIG. 2. The rear end of the on-operation prevention member 22 extends over the on-operation arm 21*b* of the operation member 21 as shown in FIG. 3. Engaging portions 22*b* and 22*c* may be formed on both sides of the on-operation prevention member 22 so as to engage corresponding first guide recesses 3*b* and 3*c* that are formed in the opposite walls 6*a* and 6*b* of the grip portion 6, respectively.

A downward inclined surface 22*j* may be formed on the upper surface of the rear portion of the on-operation prevention member 22 so as to facilitate the movement of the on-operation prevention member 22 in either directions indicated by arrows 30 and 31 in FIG. 3. Preferably, the inclined surface 22*j* may be formed with a step-like projection, so that the operator can reliably move the on-operation prevention member 22 using his finger, such as his thumb, without slipping on the inclined surface 22*j*.

The on-operation prevention member 22 may have a rear end that includes a downwardly oriented contact surface 22*a* that serves to contact the upper edge of the on-operation arm 21*a* of the operation member 21. A support portion 22*d* may be formed on the lower surface of the on-operation prevention member 22 for attachment to one end of a coil spring 23.

The first guide recesses 3*b* and 3*c* may extend substantially in a radial direction about the pivotal axis 21*c* and may incline downward in a rearward direction (right direction as viewed in FIG. 3) by a small angle with respect to the horizontal direction. Here, the relationship between Length L1 of the engaging portions 22*b* and 22*c* (distance between end 22*h* and end 22*i* of the engaging protrusion 22*b* or 22*c*) and Length L2 of the guide recesses 3*b* and 3*c* (distance between the front end 3*h* and the rear end 3*i* of the guide recesses 3*b* or 3*c*) is chosen to be L1<L2. Therefore, the engaging protrusions 22*b* and 22*c* can move along the guide recesses 3*b* and 3*c* within a distance equal to (L2−L1). As a result, the on-operation prevention member 22 can slidably move relative to the grip portion 6*a* of the handle 3.

Second guide recesses 3*e*1 and 3*e*2 are formed within the opposite walls 6*a* and 6*b* and extend downward from the middle portions of the guide recesses 3*b* and 3*c* at substantially right angles, respectively. More specifically, each of the second guide recesses 3*e*1 and 3*e*2 is connected to the corresponding first guide recess 3*b* or 3*c* at an upper end that has front and rear corner edges 3*f* and 3*g* in the longitudinal direction of the guide recess 3*b* or 3*c*. Because of the incorporation of the second guide recesses 3*e*1 and 3*e*2, the engaging portions 22*b* and 22*c* can be partly disengaged from the corresponding first guide recesses 3*b* and 3*c* in response to their position relative to the first guide recesses 3*b* and 3*c*, respectively.

Thus, distance L3 between the front corner edge 3*f* of the second guide recess 3*e*1 or 3*e*2 and the front end 3*i* of the first guide recess 3*b* or 3*c* is chosen to be less than L1. Therefore, the engaging portions 22*b* and 22*c* do not disengage from the first guide recesses 3*b* and 3*c* when the rear ends 22*i* of the engaging protrusions 22*b* and 22*c* contact the rear ends 3*i* of the first guide recesses 3*b* and 3*c*, respectively. In this position, the on-operation prevention member 22 extends to cover a substantial part of the on-operation arm 21*a* of the operation member 21. Therefore, the on-operation arm 21*a* can be prevented from being pushed by the operator.

On the other hand, distance L4 between the front end 3*h* of the first guide recess 3*b* or 3*c* and the rear corner edge 3*g* of the second guide recess 3*e*1 or 3*e*2 is chosen to be greater than L1. Therefore, when the front ends 22*h* of the engaging portions 22*b* and 22*c* contact the front ends 3*h* of the first guide recesses 3*b* and 3*c*, respectively, the rear portions of the engaging protrusions 22*b* and 22*c* may disengage from the corresponding first guide recesses 3*b* and 3*c* and may enter the corresponding second guide recesses 3*e*1 and 3*e*2 by virtue of their weight.

Therefore, in this representative embodiment, the relationship among L1, L2, L3 and L4 is chosen to be L2>L4>L1>L3. These relationships are also shown in plan view in FIG. 7.

The biasing member 23 may be interposed between the support portion 22*d* of the on-operation prevention member 22 and a support portion 3*d* formed on the handle 3, so that the support portion 22*d* is biased in a direction away from the support portion 3*d*. As a result, the on-operation prevention member 22 is normally held in the position shown in FIG. 3.

The operation of the above representative embodiment will now be explained with reference to FIGS. 3 to 6.

In the state shown in FIG. 3, the operation member 21 is in the off-holding position, in which the lower side 21*d* of the off-operation arm 21*b* contacts the upper surface of the switch body 24. In addition, the on-operation prevention member 22 is in the on-operation prevention position, in which the rear portion of the on-operation prevention member 22 substantially covers the on-operation arm 21*a* of the operation member 21. Because the power grinder 1 has been designed with the relationship L1>L3 as described above, the engaging portions 22*b* and 22*c* of the on-operation prevention member 22 cannot pivot or cannot move in the vertical direction indicated by arrow 31, so that the on-operation prevention member 22 cannot move in the vertical direction or the direction of arrow 31. Therefore, the operator cannot directly press the on-operation arm 21*a* nor press the on-operation prevention member 22 to turn on the switch device 20. However, if the operation member 21 is in the on-holding position, in which case the lower side 21*d* of the on-operation arm 21*a* is contacting the upper surface of the switch body 24, the operator can turn off the switch device 20 by pressing the off-operation arm 21*b* against the upper surface of the switch body 24.

In order to turn on the switch device 20 from the state shown in FIG. 3, the operator can perform the following two-step operation.

First, the operator applies a force to the on-operation prevention member 22 in the direction of arrow 30 by pushing the downward inclined surface 22*j* with his finger, such as his thumb, so as to move the on-operation prevention member 22 from the on-operation prevention position to a releasing position. That is, the on-operation prevention member 22 is moved in the direction of arrow 30 against the biasing force of the spring 23 until the front ends 22*h* of the engaging portions 22*b* and 22*c* contact the corresponding front ends 3*h* of the first guide recesses 3*b* and 3*c* as shown in FIGS. 4(A) and 4(B).

When the on-operation prevention member 22 is in the releasing position shown in FIGS. 4(A) and 4(B), the rear ends 22*i* of the engaging portions 22*b* and 22*c* are positioned forward of the rear corner edges 3*b*, so that each of the rear ends 22*i* vertically opposes each of the corresponding second guide recesses 3*e*1 and 3*e*2. Therefore, in this releasing position, the on-operation prevention member 22 can pivot or tilt such that the rear ends 22*i* enter the second guide recesses 3*e*1 and 3*e*2. Thus, in this position, the on-operation prevention function of the on-operation prevention member 22 can be released.

In the nest step, with the on-operation prevention member 22 held in the releasing position of FIG. 4(A) by the force applied in the direction of arrow 30 in FIG. 3, the operator presses the on-operation prevention member 22 downward in the direction of arrow 31. As a result, the engaging portions 22*b* and 22*c* pivot about the corresponding front corner edges 3*f* of the second guide recesses 3*e*1 and 3*e*2 as indicated by arrow 32 in FIG. 4(A), so that the rear ends 22*i* move from the first guide recesses 3*b* and 3*c* into the second guide recesses 3*e*1 and 3*e*2, respectively. Therefore, the on-operation prevention member 22 pivots or tilts to the on-operation position as shown in FIGS. 5(A) and 5(B).

When the on-operation prevention member 22 pivots, the contact surface 22*a* presses the on-operation arm 21*a* of the operation member 21, so that the operation member 21 pivots about the pivotal axis 21*c* in the counterclockwise direction as viewed in FIG. 5(A). When the lower side 21*d* of the on-operation arm 21*a* contacts the upper surface of the switch body 24, the switch device 20 is turned on, and the operation member 21 is held in this position by the retainer spring.

When the operator releases the pressing force that has been applied to the on-operation prevention member 22 in the state of FIG. 5(A), the on-operation prevention member 22 returns to the on-prevention position shown in FIG. 3 along the same path described above but in the opposite direction. Thus, the on-operation prevention member 22 pivots upward in a direction opposite to the direction of arrow 31 and then moves forward along the first guide recesses 3*b* and 3*c* until the front ends 22*i* of the engaging portions 22*b* and 22*c* contact the front ends 3*i* of the guide recesses 3*b* and 3*c*. However, the operation member 21 does not pivot with the on-operation prevention member 22, but instead, is held in the on-holding position as shown in FIG. 6, because the operation member 21 is a separate member from the on-operation prevention member 22.

Figure 6:
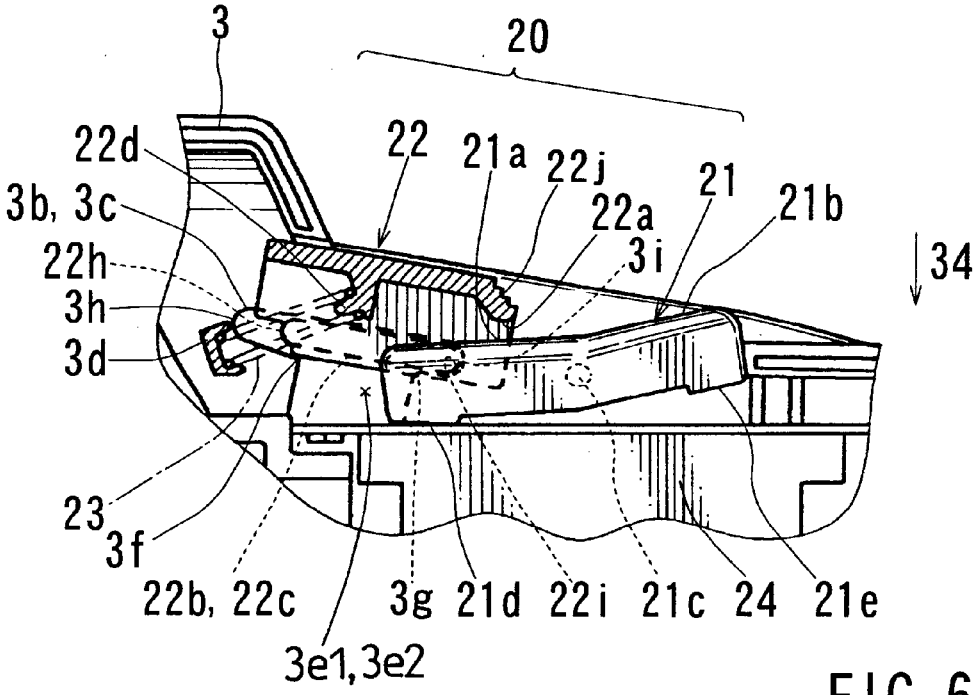
Figure 7:
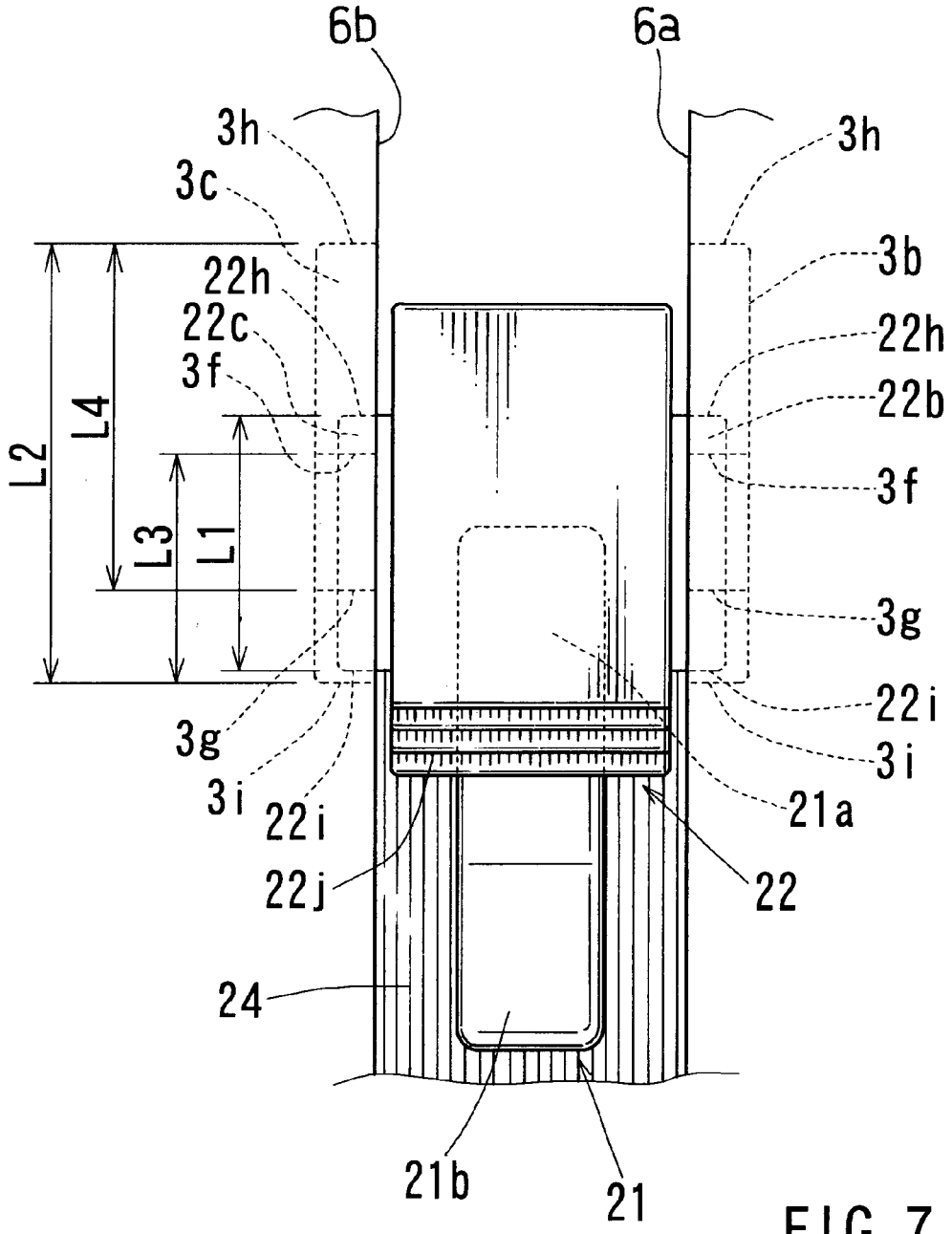
FIG. 7 is a plan view of FIG. 3.

In order to turn the switch device 20 from on to off, the operator directly presses the off-operation arm 21*b* of the operation member 21 in the direction indicated by arrow 34 in FIG. 6 until the lower side 21*e* of the off-operation arm 21*b* contacts the upper surface of the switch body 24. As a result, the operation member 21 pivots in the clockwise direction about the pivotal axis 21*c* as viewed in FIG. 6 to the off-holding position.

Figure 8:
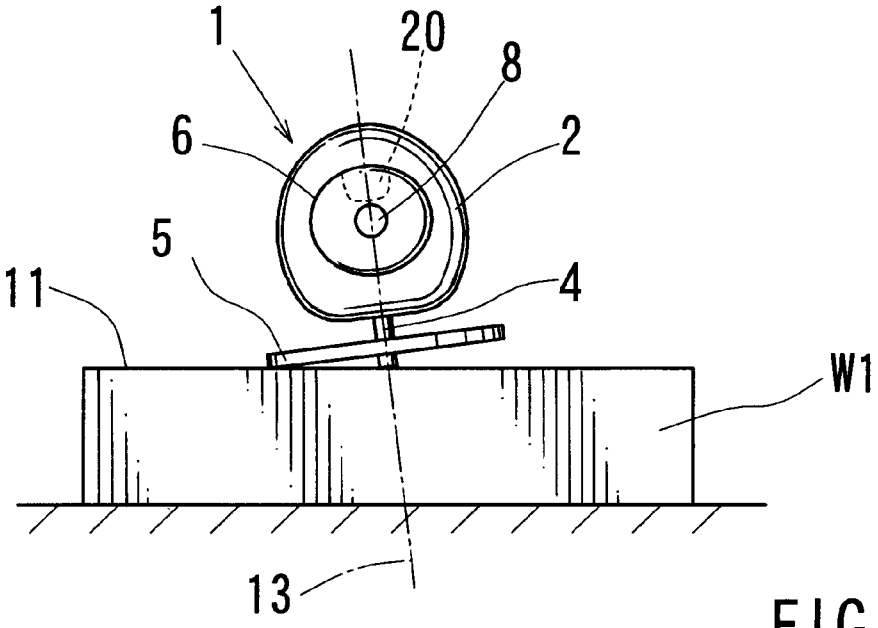
FIGS. 8 and 9 are schematic views of the representative power grinder in an abrading mode and a cutting mode, respectively.
Figure 9:
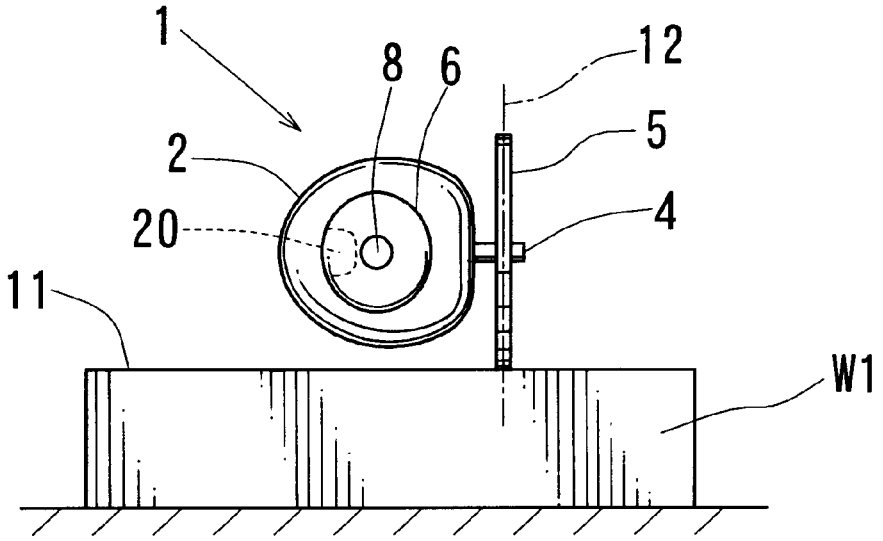
Figure 10:
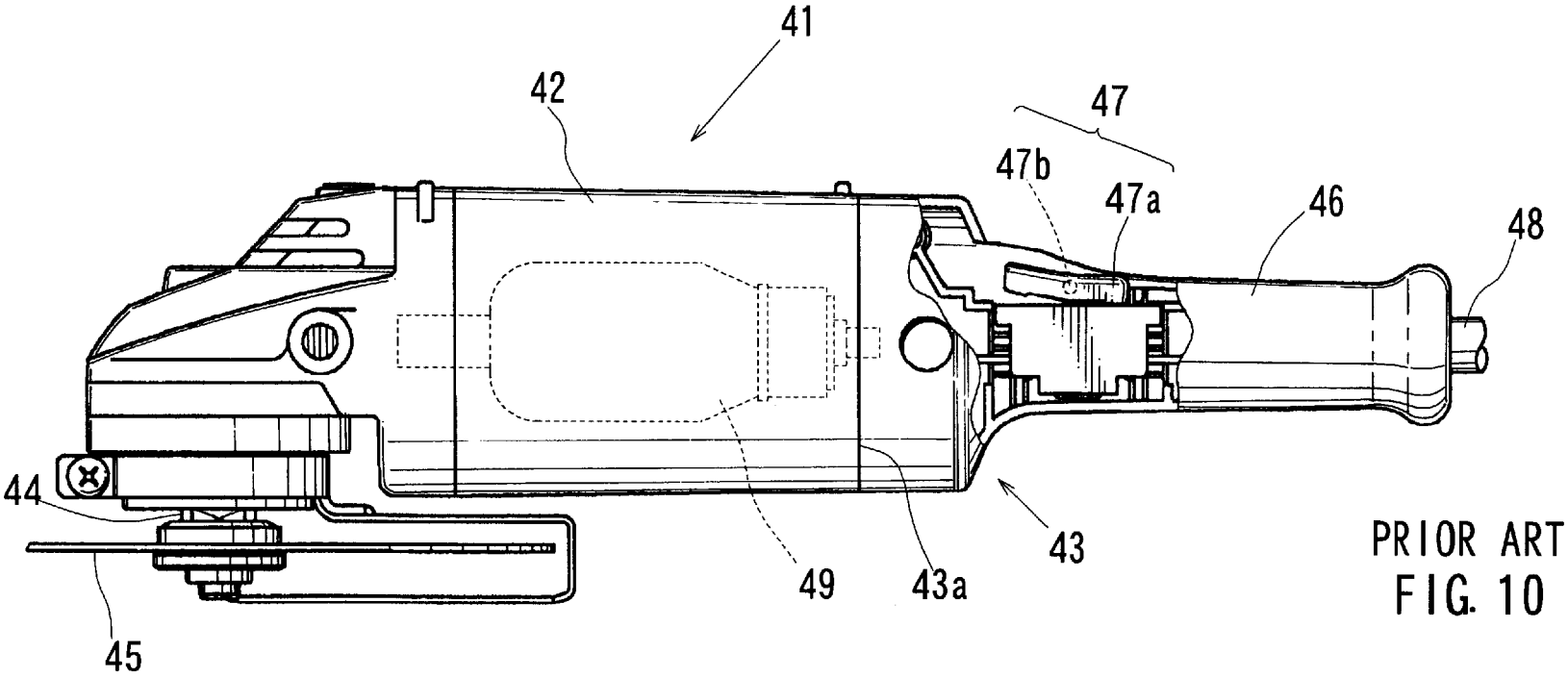
PRIOR ART FIG. 10
FIG. 10 is a side view of a known power grinder.

As shown in FIGS. 8 and 9, the grinder 1 of this representative embodiment can be suitably used both in an abrading or polishing mode and in a cutting mode, respectively. Thus, in the abrading or polishing mode shown in FIG. 8, a spindle axis 13 is positioned to extend nearly perpendicular to surface 11 of the workpiece W1 to be machined. On the other hand, in the cutting mode shown in FIG. 9, the disk plane 12 is positioned to extend nearly perpendicular to the workpiece surface 11. Because the switch device 20 may have a compact construction, the operator can easily operate the switch device 20 in both of these different modes.

According to this representative embodiment of the switch device 20, accidental switching operations of the switch device 20 from off to on can be reliably prevented, because the on-operation prevention member 22 is normally positioned to substantially cover the on-operation arm 21*a* of the operation member 21.

In addition, two different operations can be sequentially performed including (1) an operation of releasing the on-operation prevention function of the on-operation prevention member 22 and (2) an operation of pressing the on-operation arm 21*a* by means of the on-operation prevention member 22. Therefore, the operation for turning on the switch device 20 can be smoothly performed without complicating the operability of the switch device 20. As a result, accidental switching operations of the switch device 20 also can be prevented in this respect.

Further, when the pressing force applied to the on-operation prevention member 22 is released after the switch device 20 has been turned on, the on-operation prevention member 22 can automatically return to the on-operation prevention position as a result of the biasing force of the spring 23. Therefore, the on-operation prevention function can be reliably preformed.

Furthermore, because the grip portion 6 of the handle 3 has the same central axis 10 as the housing 2, the operator can easily adjust the pressing force that is required to be applied to the workpiece surface during the machining operation in either the abrading or cutting modes as discussed previously with reference to FIGS. 8 and 9.

Although in the above representative embodiment the switch device 20 and its operation member 21 are mounted on the handle 3 on the side opposite to the disk 5 or the upper side as viewed in FIG. 1, the position of the operation member 21 can be suitably changed. In addition, the configuration and the size of the operation member 21 can be suitably varied.

In addition, although the housing 2 and the handle 3 have a substantially cylindrical configuration, each may have different configurations.

Further, the engaging portions 22*b* and 22*c* may have various configurations as long as each can engage the first guide recesses 3*b* and 3*c*, respectively.

Moreover, the representative example has been described in terms of a power grider. However, the present invention is applicable to all types of power tools.

What is claimed is:

1. A power tool comprising:

a motor and a switch device for starting and stopping the motor, the switch device including an operation member and an on-operation prevention device;

the operation member being pivotable about a pivotal axis between an on position and an off position and having an on-operation arm and an off-operation arm on either side of the pivotal axis for operation by an operator, and the on-operation prevention device being operable to prevent and permit the operation member from moving from the off position to the on position;

wherein the on-operation prevention device serves to prevent the on-operation arm from being accessed by the operator and includes an on-operation prevention member that is movable between a prevention position for preventing the on-operation arm from being operated by the operator and a releasing position for permitting the on-operation arm to be operated by the operator, the on-operation prevention member being movable from the prevention position to an on-operation position via the releasing position so as to move the operation member from the off position to the on position by moving the on-operation arm.

2. The power tool as defined in claim 1 further including a biasing member for normally biasing the on-operation prevention member in a direction toward the on-prevention position.

3. The power tool as defined in claim 1, wherein the on-operation prevention member substantially covers the on-operation arm of the operation member when the on-operation prevention member is in the prevention position and substantially uncovers the on-operation arm when the on-operation prevention member is in the releasing position.

4. The power tool as defined in claim 1, wherein the on-operation prevention member can move from the prevention position to the releasing position in a first direction and can move from the releasing position to the on-operation position in a second direction.

5. The power tool as defined in claim 4 further including a guide device for permitting combined movement of the on-operation prevention member in the first and second directions.

6. A power tool comprising:

a motor and a switch device for starting and stopping the motor, the switch device including an operation member and an on-operation prevention device;

the operation member being pivotable about a pivotal axis between an on position and an off position and having an on-operation arm and an off-operation arm on either side of the pivotal axis for operation by an operator, and the on-operation prevention device being operable to prevent and permit the operation member from moving from the off position to the on position, wherein the on-operation prevention device includes an on-operation prevention member that is movable between a prevention position for preventing the on-operation arm from being operated by the operator and a releasing position for permitting the on-operation arm to be operated by the operator; and, wherein the on-operation prevention member can move from the prevention position to an on-operation position via the releasing position so as to move the operation member from the off position to the on position by moving the on-operation arm; and, wherein the on-operation prevention member can move from the prevention position to the releasing position in a first direction and can move from the releasing position to the on-position in a second direction, and, wherein the first direction is a substantially radial direction about the pivotal axis of the operation member, and the second direction is substantially perpendicular to the first direction.

7. The power tool as defined in claim 6 further including a biasing member for applying a first biasing force in the first direction to move the on-operation prevention member from the on-operation position to the releasing position and for applying a second biasing force in the second direction to move the on-operation prevention member from the releasing position to the prevention position.

8. The power tool as defined in claim 7, wherein the biasing member includes a single spring interposed between a portion of a tool body and the on-operation prevention member, wherein the spring applies both the first and second biasing forces.

9. A power tool comprising:

a motor and a switch device for starting and stopping the motor, the switch device including an operation member and an on-operation prevention device;

the operation member being pivotable about a pivotal axis between an on position and an off position and having an on-operation arm and an off-operation arm on either side of the pivotal axis for operation by an operator, and the on-operation prevention device being operable to prevent and permit the operation member from moving from the off position to the on position, wherein the on-operation prevention device includes an on-operation prevention member that is movable between a prevention position for preventing the on-operation arm from being operated by the operator and a releasing position for permitting the on-operation arm to be operated by the operator; and, wherein the on-operation prevention member can move from the prevention position to an on-operation position via the releasing position so as to move the operation member from the off position to the on position by moving the on-operation arm; and, wherein the on-operation prevention member can move from the prevention position to the releasing position in a first direction and can move from the releasing position to the on-operation position in a second direction, and, wherein the power tool further includes a guide device for permitting combined movement of the on-operation prevention member in the first and second directions; wherein:

the guide device includes an engaging portion and a guide recess, the engaging portion being formed on the on-operation prevention member and the guide recess being formed in a portion of a tool body so as to engage the engaging portion;

the guide recess including a first guide recess and a second guide recess, the first guide recess extending in the first direction, and the second guide recess extending substantially perpendicular to and intersecting with the first guide recess;

the first guide recess having a first recess end on the side opposite to the operation member and a second recess end on the side of the operation member;

the engaging portion having a first engaging end on the side opposite to the operation member and a second engaging end on the side of the operation members;

the second guide recess intersecting the first guide recess at an intersecting end that has a first corner edge on the side opposite to the operation member and a second corner edge on the side of the operation member; and, wherein length L1 is defined between the first engaging end and a second engaging end of the engaging portion, length L2 is defined between the first recess end and the second recess end of the first guide recess, length L3 is defined between the second recess end and the first corner edge, L4 is defined between the first recess end and the second corner edge, and the relationship among L1, L2, L3 and L4 is chosen to be L2>L4>L1>L3;

whereby the second engaging end of the engaging portion can move into the second guide recess, so that the on-operation prevention member can pivot in the second direction when the first end of the engaging portion is substantially positioned at the first recess end of the first guide recess.

10. A power tool comprising a motor and a switch device coupled to the motor, the switch device comprising:

an operation member that pivots about a pivotal axis between an on position and an off position, the operation member comprising an on-operation arm and an off-operation arm, each disposed on opposite sides of the pivotal axis, and means for preventing the operating member from pivoting to the on position;

wherein the on-operation prevention means shields the on-operation arm from being accessed by the operator and comprises:

an on-operation prevention member that can move between a on operation prevention position, in which the on-operation arm can not be operated by the operator and a releasing position, in which the on operation arm can be operated by the operator;

wherein the on-operation prevention member substantially covers the on-operation arm of the operation member when the on-operation prevention member is in the on-operation prevention position and substantially uncovers the on-operation arm of the operation member when the on-operation prevention member is in the releasing position.

11. The power tool as defined in claim 10 further comprising means for biasing the on-operation prevention member in a direction toward the on-operation prevention position.

12. The power tool as defined in claim 11, wherein the on-operation prevention member can move from the on-operation prevention position to an on-operation position via the releasing position so as to move the operation member from the off position to the on position by moving the on-operation arm.

13. The power tool as defined in claim 12, wherein the on-operation prevention member can move from the on-operation prevention position to the releasing position in a first direction and can move from the releasing position to the on-operation position in a second direction.

14. A power tool comprising a motor;

a switch device coupled to the motor, the switch device comprising:

an operation member that pivots about a pivotal axis between an on position and an off position, the operation member comprising an on-operation arm and an off-operation arm, each disposed on opposite sides of the pivotal axis, and means for preventing the operating member from pivoting to the on position;

wherein the on-operation prevention means shields the on-operation arm from being accessed by the operator and comprises:

an on-operation prevention member that can move between an on operation prevention position, in which the on-operation arm can not be operated by the operator and a releasing position, in which the on operation arm can be operated by the operator;

and further comprising means for biasing the on-operation prevention member in a direction toward the on-operation prevention position;

wherein the on-operation prevention member substantially covers the on-operation arm of the operation member when the on-operation prevention member is in the on-operation prevention position and substantially uncovers the on-operation arm of the operation member when the on-operation prevention member is in the releasing position;

wherein the on-operation prevention member can move from the on-operation prevention position to an on-operation position via the releasing position so as to move the operation member from the off position to the on position by moving the on-operation arm;

wherein the on-operation prevention member can move from the on-operation prevention position to the releasing position in a first direction and can move from the releasing position to the on-operation position in a second direction; and wherein the first direction is a substantially radial direction about the pivotal axis of the operation member, and the second direction is substantially perpendicular to the first direction.

15. The power tool as defined in claim 14 further comprising means for permitting combined movement of the on-operation prevention member in the first and second directions.

16. The power tool as defined in claim 15 further comprising means for biasing on-operation prevention member in the first direction and in the second direction.

17. The power tool as in claim 15 further comprising a spring interposed between a portion of the power tool and the on-operation prevention member, the spring biasing the on-operation prevention member in the first and second directions.

18. The power tool as defined in claim 15 further comprising a spring interposed between a portion of the power tool and the on-operation prevention member, the spring biasing the on-operation prevention member in the first and second directions.

19. The power tool as defined in claim 14 further comprising a guide device comprising:

an engaging portion formed on the on-operation prevention member and having a first engaging end on the side opposite to the operation member and a second engaging end on the side of the operation member and a first guide recess and a second guide recess receiving the engaging portion, both the first guide recess and the second guide recess being formed in a portion of the power tool, wherein the first guide recess extends in the first direction and the second guide recess extends substantially perpendicular to the first guide recess, wherein the first guide recess has a first recess end on the side opposite to the operation member and a second recess end on the other side of the operation member, wherein the second guide recess intersects the first guide recess at an intersecting end that has a first corner edge on the side opposite to the operation member and a second corner edge on the side of the operation member, wherein length L1 is defined between the first engaging end and a second engaging end of the engaging portion, length L2 is defined between the first recess end and the second recess end of the first guide recess, length L3 is defined between the second recess end and the first corner edge, and L4 is defined between the first recess end and the second corner edge and L2>L4>L1>L3, and whereby the second engaging end of the engaging portion can move into the second guide recess, such that the on-operation prevention member will pivot in the second direction when the first end of the engaging portion is substantially positioned at the first recess end of the first guide recess.

20. A power tool comprising:

a motor and a switch coupled to the motor, the switch comprising:

an operation member that pivots about a pivotal axis between an on position and an off position, the operation member comprising an on-operation arm and an off-operation arm, each disposed on opposite sides of the pivotal axis, and an on operation prevention device comprising:

an engaging portion formed on the on-operation prevention member and having a first engaging end on the side opposite to the operation member and a second engaging end on the side of the operation member and a first guide recess and a second guide recess receiving the engaging portion, both the first guide recess and the second guide recess being formed in a portion of the power tool, wherein the first guide recess extends in a first direction and the second guide recess extends in a direction substantially perpendicular to the first guide recess, wherein the first guide recess has a first recess end on a side that is opposite to the operation member and a second recess end on the other side of the operation member, wherein the second guide recess intersects the first guide recess at an intersecting end that has a first corner edge on the side opposite to the operation member and a second corner edge on the side of the operation member, wherein length L1 is defined between the first engaging end and a second engaging end of the engaging portion, length L2 is defined between the first recess end and the second recess end of the first guide recess, length L3 is defined between the second recess end and the first corner edge, and L4 is defined between the first recess end and the second corner edge and L2>L4>L1>L3, and whereby the second engaging end of the engaging portion can move into the second guide recess, such that the on-operation prevention member will pivot in the second direction when the first end of the engaging portion is substantially positioned at the first recess end of the first guide recess.

21. A power tool comprising a motor and a switch device for starting and stopping the motor, the switch device including an operation member and an on-operation prevention device;

the operation member being pivotable about a pivotal axis between an on position and an off position and having an on-operation arm and an off-operation arm on either side of the pivotal axis for operation by an operator, and the on-operation prevention device being operable to prevent and permit the operation member from moving from the off position to the on position;

wherein the on-operation prevention device serves to prevent the on-operation arm from begin accessed by the operator and includes an on-operation prevention member that is movable between a prevention position for preventing the on-operation arm from being operated by the operator and a releasing position for permitting the on-operation arm to be operated by the operator; and, wherein the on-operation prevention member is movable substantially in a radial direction with respect to the pivotal axis between the prevention position and the releasing position.

22. The power tool of claim 21 wherein the on-operation prevention member substantially covers the on-operation arm but substantially uncovers the off-operation arm, when the on-operation prevention member is in the prevention position.

23. A power tool comprising a motor and a switch device for starting and stopping the motor, the switch device including an operation member and an on-operation prevention device;

the operation member being pivotable about a pivotal axis between an on position and an off position and having an on-operation arm and an off-operation arm on either side of the pivotal axis for operation by an operator, and the on-operation prevention device being movable between a first position for preventing the operation member from moving from the off position to the on position and a second position for allowing the operation member to move from the off position to the on position independently of the position of the operation member.

24. A hand-held power tool comprising:

a handle;

a motor;

a switch device mounted in the handle for starting and stopping the motor;

the switch device including an operation member and an on-operation prevention device;

the operation member being pivotable about a pivotal axis between an on position and an off position and having an on-operation arm and an off-operation arm on either side of the pivotal axis for operation by an operator, and the on-operation prevention device being operable to prevent and permit the operation member from moving from the off position to the on position.

25. The hand-held power tool of claim 24 wherein said power tool is adapted to be held by one hand of a user and wherein the on-operation prevention device and the operation member can be actuated by the one hand.

* * * * *